United States Patent [19]

Pavliscak et al.

[11] 3,990,560

[45] Nov. 9, 1976

[54] AUTOMATIC MEDIA THICKNESS COMPENSATOR FOR A PRINTER

[75] Inventors: Thomas J. Pavliscak, Centerville; William S. Touchman, Kettering, both of Ohio

[73] Assignee: NCR Corporation, Dayton, Ohio

[22] Filed: Aug. 4, 1972

[21] Appl. No.: 278,172

[52] U.S. Cl. ..... 197/1 R; 197/127 R

[51] Int. Cl.[2] ..... B41J 3/04

[58] Field of Search ..... 197/1, 18, 49, 55, 126, 197/127, 128, 137, 149; 346/76 R, 74 CH, 74 E, 74 M, 74 MC, 139 A, 139 C; 235/61.9; 101/35, 41–44; 340/259

[56] References Cited

UNITED STATES PATENTS

| | | | |
|---|---|---|---|
| 2,141,975 | 12/1938 | Finch | 346/139 A |
| 3,146,058 | 8/1964 | Henshaw | 346/139 C |
| 3,592,311 | 7/1971 | Chow et al. | 197/1 R |
| 3,705,408 | 12/1972 | Krone et al. | 346/139 C |

*Primary Examiner*—Ralph T. Rader
*Attorney, Agent, or Firm*—J. T. Cavender; Albert L. Sessler, Jr.; Elmer Wargo

[57] ABSTRACT

A carriage having a print head thereon is traversed along a platen to enable the print head to print along a line of printing in a serial-type printer. The print head moves with the carriage and is also mounted thereon for independent movement towards and away from the platen. A leaf spring biases the print head towards the platen, and a sensing shoe, secured to the print head, glides along media of various thickness mounted on the platen to maintain the print head (like a wire matrix) a predetermined distance from the media enabling the print head to print on various thicknesses of media automatically.

8 Claims, 12 Drawing Figures

AUTOMATIC MEDIA THICKNESS COMPENSATOR FOR A PRINTER

BACKGROUND OF THE INVENTION

This invention relates to an automatic forms compensator for sensing the thicknesses of various media mounted on a platen of a serial type printer, and for maintaining the print head thereof, a predetermined distance way from the particular medium being printed upon.

One variety of a prior art wire matrix printer, which is designed to produce characters while using the "5 by 7" matrix format, utilizes a print head in which seven print head wires are arranged in a vertical column, and the print head is indexed serially along a line of printing on the platen associated with the printer. Actuation of the seven print head wires in one "impact" is all that is necessary to complete a simple character like the numeral "1", for example; however, to produce a more complicated character like the letter "M" up to five successive "indexes" and five selective "impacts" by the print head wires may be necessary to complete the printing of the character while the print head is traversed along the line of printing. In order to obtain a fast rate of printing, it is necessary that the associated hammers which drive the matrix print head wires operate with a very short stroke. The short stroke of the print head wires makes a printer employing this type of printing mechanism of limited value in accounting machines, for example, because for this type of machine, it is necessary that the printing mechanism be capable of printing on a variety of thicknesses of media. It is necessary that the print mechanism for an accounting machine print on a tally or audit roll which has a complete record of all transactions and also print on a pass or bank book. Obviously, a bank book is generally much thickner than an audit roll, and this wide range of thicknesses of media makes it extremely difficult for a wire matrix printer with a short stroke drive mechanism to print satisfactorily when media of such varying thicknesses are mounted on the same platen. If the platen is adjusted backward to accommodate the thick pass book, for example, the short stroke drive mechanism will not be able to impact the matrix print head wires against the thinner audit roll, and if the platen is adjusted forward for printing upon the thinner audit roll, it is possible that there might be insufficient clearance between the print head and the pass book to permit the print head to pass thereover, and jamming of the print head against the edge of the pass book will result.

The present invention eliminates the problems cited in the previous paragraph, in that the forms compensator disclosed herein will enable the print mechanism of an impact printer (like a wire matrix printer) to print satisfactorily on media of varying thicknesses mounted on a platen, automatically, without any attention from an operator of the machine. In prior art printers, it was necessary for an operator to adjust the platen either forward or backward, depending upon the thickness of the media inserted thereon.

Another advantage of the present invention is that a sensing means which is employed in the automatic forms compensator to sense the thickness of the media to be printed upon, is also utilized for lightly compressing multi-ply forms so as to enable a larger number of clearer copies to be produced by a printer employing this invention than is attainable by a printer of the prior art.

Another feature of the present invention is that the forms compensator permits the associated print head to be retracted to permit visual inspection of a line being printed. The retraction of the print head can be effected either manually or mechanically.

SUMMARY OF THE INVENTION

This invention relates to an automatic forms compensator for sensing the thicknesses of various media mounted on the platen of a serial-type printer and for maintaining the print head thereof at a predetermined distance away from the particular medium being printed upon.

The compensator includes a carriage means having a print head means mounted thereon, and traversing means for traversing the carriage means along a platen of the printer to enable the print head means to print along a line of printing on the platen. Mounting means are used for mounting the print head means on the carriage means to enable the print head means to be simultaneously traversed with the carriage means and to enable the print head means to be reciprocated along a second line which is perpendicular to the line of printing. Biasing means are used to resiliently urge the print head means towards the platen, and sensing means, secured to the print head means, are used to contact the media on the platen and to move the print head means away from the media as a thicker medium is encountered along the line of printing, and to enable the biasing means to move the print head means towards the platen as a thinner medium on the platen is encountered, thereby enabling the print head means to be spaced a predetermined distance from said media along the line of printing regardless of the thickness of the particular medium mounted on the platen. The sensing means includes a variety of sensing shoes of special shapes which shoes are utilized in contacting the media on the platen.

DETAILED DESCRIPTION OF THE INVENTION

Figure 1:
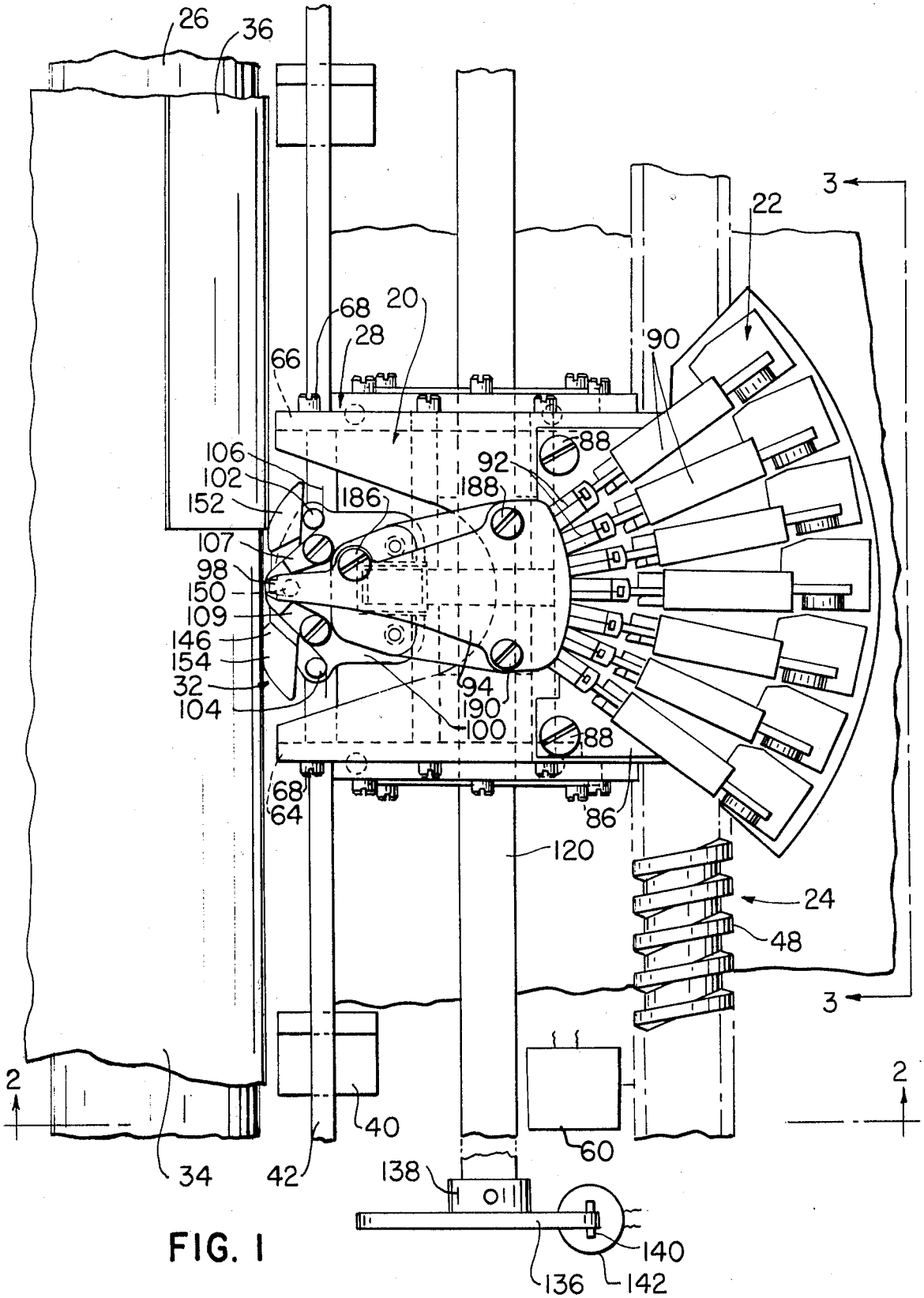
FIG. 1 is a plan view of a portion of a serial-type wire matrix printer showing the forms compensator of this invention.

FIG. 1 is a plan view of a portion of a serial-type, wire-matrix, line printer on which the forms compensator of this invention is mounted. The forms compensator comprises a carriage means 20 having a conventional wire matrix print head means 22 mounted thereon. A traversing means 24 traverses the carriage means 20 along a platen 26 of the printer to enable the print head means to print along a line of printing on the platen. The forms compensator also includes a mounting means 28 for mounting the print head means 22 on the carriage means 20 to enable the print head means to be reciprocated along a line which is perpendicular to the line of printing along the platen. A biasing means 30 (FIG. 2) is used to resiliently urge the print head means 22 towards the platen 26. A sensing means 32, secured to the print head means 22, is used to sense the thicknesses of the media located on the platen and to move the print head means away from said media, against the bias of said biasing means 30, as a thicker medium is encountered along the line of printing. The biasing means 30 then moves the print head means 22 towards the platen 26 as a thinner medium is encountered. This action permits the print head means 22 to be spaced a predetermined distance from the media along the line of printing regardless of the thickness of the particular medium mounted on the platen and being printed upon.

Media of various thicknesses are shown on the platen 26 in FIG. 1, as for example, medium 34 may be a single sheet tally or audit roll, and medium 36 may be a multi-sheet pass or bank book. The forms compensator of this invention is capable of automatically adjusting the print head means 22 relative to the platen 26 in response to the thickness of the particular medium being printed upon. Having media of different thicknesses mounted on the same platen to be printed upon along a single line of printing is common in accounting machine practices.

Figure 2:
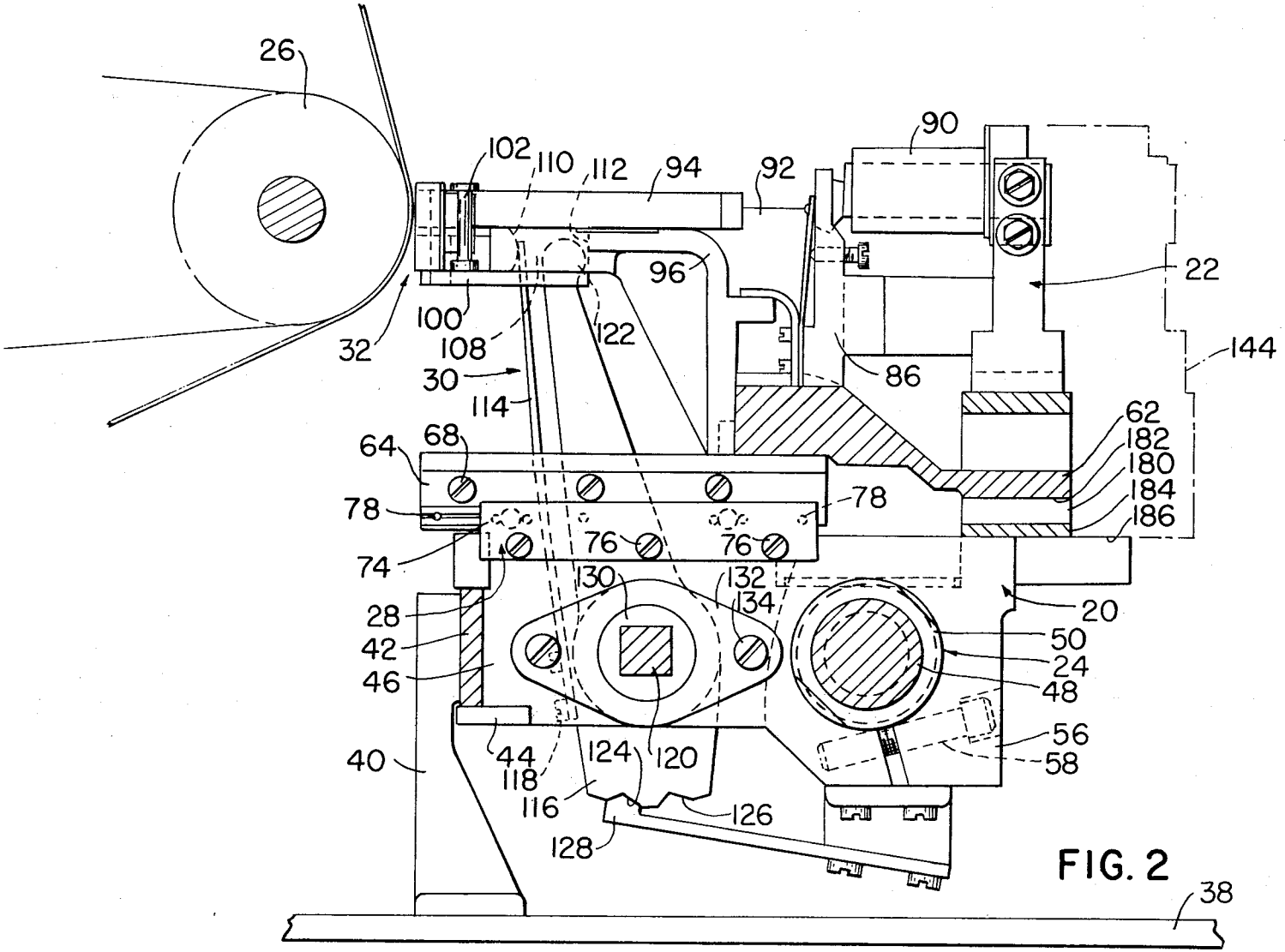
FIG. 2 is a side view, in elevation, taken along the line 2—2 of FIG. 1 to show additional details of the forms compensator, including a biasing means for urging the print head means of the printer towards the platen thereof.

The carriage means 20, alluded to earlier, includes a base 38 having brackets 40 upstanding therefrom as shown in FIG. 2. These brackets 40 support a horizontally positioned rail 42 which is positioned parallel to the rotating axis of the platen 26, and a flat horizontally positioned rail 44 is secured to the underside of the rail 42 as shown in FIG. 2. A carriage member 46, of the carriage means 20, abuts against the rail 42 and rests upon the rail 44.

Figure 3:
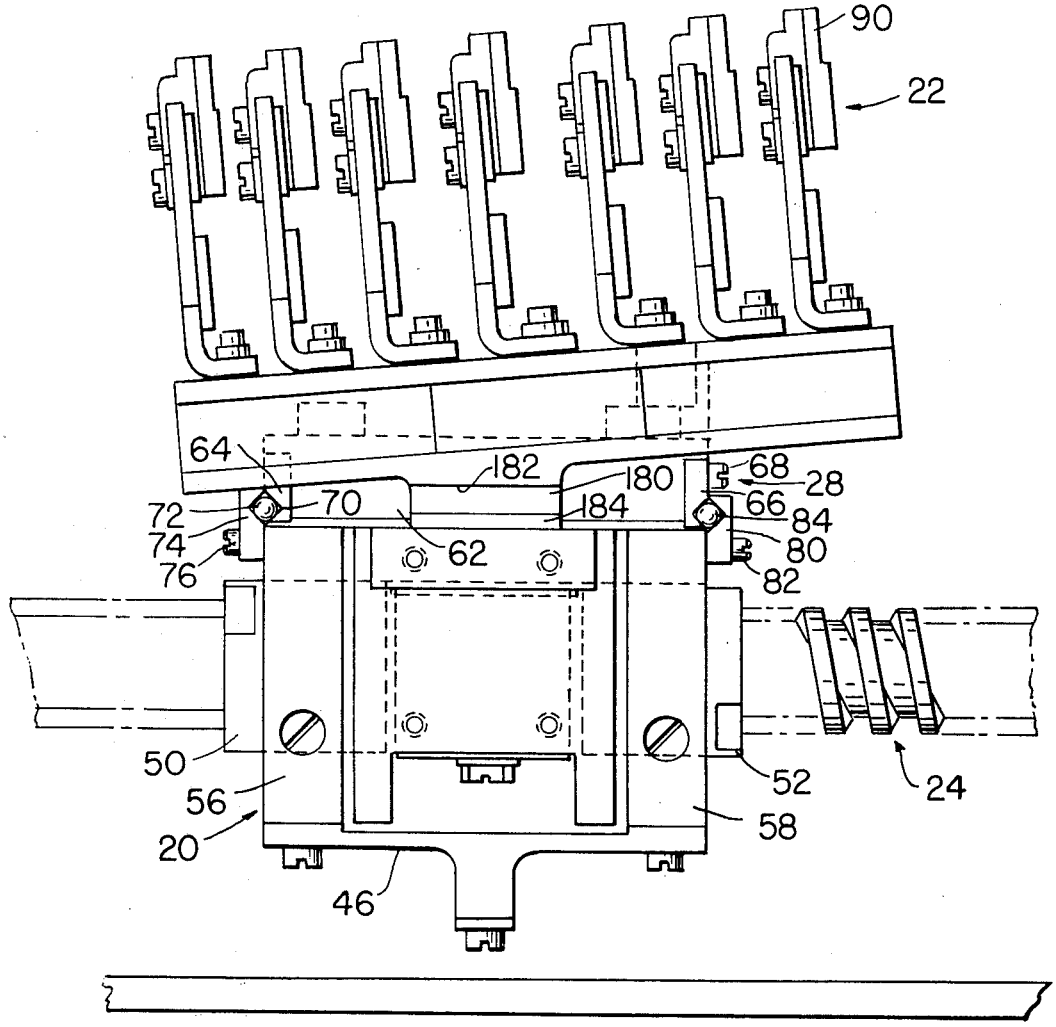
FIG. 3 is a rear view, in elevation, taken along the line 3—3 of FIG. 1 to show additional details of a means for mounting the print head means for reciprocal movement towards and away from the platen.

A conventional traversing screw 48, of the traversing means 24, passes through the carriage number 46, and is coupled thereto by the construction shown principally in FIG. 3. This construction includes two nuts 50 and 52 which are inserted into split bushings or protrusions 56 and 58 respectively, which bushings are secured to the carriage member 46. The nuts 50 and 52 are adjusted on the traversing screw 48 in a conventional manner so as to provide a minimum of backlash of the carriage member 46 on the screw 48 over the entire length thereof, and each nut is then clamped in its associated bushing by a fastener 58 as shown in FIG. 2. The ends of the traversing screw 48 are conventionally supported in bearing (not shown), and the screw 48 is rotated by a conventional constant-speed motor (synchronous or servo controlled) or a stepping motor 60 (FIG. 1) to traverse the carriage means 20 along the platen 26 as the characters are printed by the wire-matrix, print head means 22. During printing, the stepping motor 60 runs as a continuous motor, and the dots printed by the seven print head wires which are arranged in a column (as described earlier in the Background of the Invention) are really printed "on the fly" as the print head means 22 is traversed along the line of printing by the motor 60. The main advantage of the stepping motor 60 is that it is low cost and fairly easy to control by electronics. Because these aspects may be conventional, they are not described in detail.

The mounting means 28, for mounting the wire print head means 22 on the carriage means 20 for reciprocating movement towards and away from the platen 26, is shown in FIGS. 1, 2, and 3. The mounting means 28 includes a base 62 (best seen in FIG. 3) which base has vertically extending sides against which plates 64 and 66 are secured by fasteners 68. The plate 64 has a horizontally positioned "V"-shaped groove on the outer face thereof, into which groove, a plurality of ball bearings 72 is positioned. A plate 74, also has a horizontally V-shaped groove therein, which groove is complementary in shape to the groove 70 in plate 64, and the plate 74 is fastened to the carriage member 46 by fasteners 76 to retain the ball bearings in the grooves and support the left end (as viewed in FIG. 3) of the base 62. A pin 78 (FIG. 2) projects from the plate 64 into the associated groove at opposed ends of the plate to retain the ball bearings in the grooves between the plate 64 and 74. The right side of the base 62 is similarly supported by the plate 66 and a plate 80, which latter plate is fastened to the carriage member 46 by fasteners 82. Ball bearings 84 are positioned in the grooves between plates 66 and 80 as previously explained in connection with plates 64 and 74. By this construction the print head means 22 is mounted on the carriage means 20 for perpendicular movement towards and away from the platen 26 while the carriage means 20 is being traversed along a print line on the platen 26.

Figure 12:
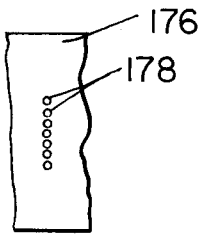
FIG. 12 is an elevational view taken along the line 12—12 of FIG. 11 to show additional details of the combined sensing shoe and housing shown in FIG. 11.

The wire matrix print head means 22 includes a wire matrix print head unit 86 which is secured to the base 62 on the carriage member 46 by two fasteners 88 shown in FIG. 1. The print head unit 86 has conventional actuators like 90 and print wires or wire plungers 92 which are supported in a wire guide or housing 94 which is supported on a bracket 96 secured to the base 62. The wire plungers 92, when actuated, come out of the end 98 (FIG. 1) of the housing 94 and impact against a medium on the platen. The print head unit 86 is of a known variety which utilizes seven wire plungers 92 located in a vertical line as shown in FIG. 12. In order to print a complete character, like the letter "M", for example, when using a five by seven matrix format. The stepping motor 60 would run as a continuous motor to move the print head along the line of printing on the platen, and five successive impacts by the print head unit 86 would be required to complete the letter. One prior art print head unit, like the one described, has control electronics which include a "run emitter" clock which is operatively associated with the traversing screw 48 and the motor 60 to allow the screw to rotate at a constant speed. A "print emitter clock" also associated with the traversing screw 48 and motor 60 in combination with the control electronics creates the necessary fire pulses (to the actuators 90) which pulses are phased with the motion of the traversing screw 48 to enable accurate horizontal spacing of the "dots" produced by the successive impacts of the print head unit 86. Because the techniques for energizing the print head unit 86 are conventional, they are not described in any further detail herein. A plate 100 (FIG. 2), secured to the bracket 96, supports two spaced and vertically positioned posts 102 and 104 which are used as ribbon guides. As shown in FIG. 1, an inked ribbon 106 passes behind post 102, around the front end of an adjustably fixed deflector guide 107 and one side of the end 98 of the housing 94, around the front end 98 of housing 94, around the front end of an adjustably fixed deflector guide 109 located on the opposite side of the housing 94, and behind the second post 104. The bracket 96 has a well 108 (FIG. 2) located therein beneath the housing 94, and a curved wall 110 and a vertically positioned flat wall 112 form opposed contact areas in said well.

The biasing means 30 alluded to earlier is shown in FIG. 2. As stated earlier, the biasing means 30 is used to resiliently urge the wire matrix print head means 22 towards the platen 26 along a line which is perpendicular to a line of printing thereon; it should be recalled that the print head means 22 is mounted for reciprocal movement relative to the platen. The biasing means 30 includes a leaf-type spring 114, having one end fixed to a lever 116 by fasteners 118. The free end 122 of the spring 114 passes through a suitable slot in the carriage member 46 and extends into the well 108 and abuts against the curved wall 110 therein to resiliently urge the print head means 22 towards the platen 26. The lever 116 has a square hole therein, between the ends thereof, enabling the lever to be slidably mounted on a bar 120 which is square in cross section as shown in FIG. 2. The bar 120 extends along the length of the platen and is parallel to the traversing screw 48. Bar 120 has its ends conventionally, rotatably mounted in the side frames (not shown) of a printer in which this invention is located. One end 122 of lever 116 passes through a suitable slot in the carriage member 46 and extends into the well 108 located in the bracket 96. The remaining end of the lever 116 has two notches 124 and 126 therein to receive a pawl member 128. The lever 116 also has a hub portion 130 fixed thereto on each side thereof, and each hub portion has a square opening therein which is aligned with the square opening in the lever 116 to provide a sliding fit on the square bar 120. Each hub portion like 130 is rotatably mounted in an apertured flange 132 which is secured to the carriage member 46 by fasteners 134. By this construction, the lever 116 is carried by the carriage member 46 as it is traversed along the platen 26 and is capable of being independently rotated in clockwise and counterclockwise directions by the square bar 120. A lever 136 (FIG. 1) is fixed to the bar 120 by a flange 138 to rotate the bar. One end of the lever 136 has an actuating arm 140 of a solenoid 142 secured thereto.

The print head means 22 is moved away from the platen 26 to permit the insertion of media 34, 36 by the construction just described. When the solenoid 142 is energized, the operating arm 140 (FIG. 1) rotates the lever 136 and bar 120 in a clockwise direction (as viewed in FIG. 2). When so rotating, the lever 116 which is slidably secured to square bar 120, will also be rotated in a clockwise direction enabling end 122 thereof to contact the vertical wall 112 in well 108 and move the entire print head means 22 away from the platen 26 to the position shown by the dashed outline 144 in FIG. 2. The mounting means 28, already described, enable the lever 136 to move the print head means away from the platen 26, and it is held in the away position by the pawl member 128 entering notch 126 (FIG. 2) after the lever 116 is rotated. When the solenoid 142 is deenergized, a spring (not shown) associated with the operating plunger 140 thereof, will return the print head means 22 to the position shown in solid lines in FIG. 2 in which pawl member 128 enters notch 124 as shown. This position enables the print head means 22 to move freely towards the platen 26 to engage it without the end 122 of lever 116 contacting the vertical wall 112. The leaf spring 114, secured to lever 116, urges the print head means 22 towards the platen 26.

The sensing means 32, (FIGS. 1 and 2) alluded to earlier, is secured to the print head means 22 to contact the media on the platen 26, and to move the print head means away from the media as a thicker medium is encountered along the line of printing, and to enable the biasing means 30 to move the print head means 22 towards the platen as a thinner medium is encountered, thereby enabling the print head means 22 to be spaced a predetermined distance away from the particular medium being printed upon regardless of its thickness. This adjustment is made automatically without any adjustment by an operator using this invention.

The sensing means 32 includes a sensing shoe 146, one embodiment of which is shown in FIGS. 1, 5, 6, and 7. The shoe 146 has a hole 148 therein enabling the shoe to be privotally mounted on a pin 150 which is vertically mounted on the plate 100. The sensing shoe 146 has chamfered edges 152 and 154 to contact the media on the platen 26, and the central portion of the shoe 146 is notched out to permit the end 98 of the print head to pass therethrough (FIG. 2). The face of the shoe 146 which contacts the media on the platen has a radius of curvature R (FIG. 6) which is slightly larger than the radius of the platen 26.

Figure 8:
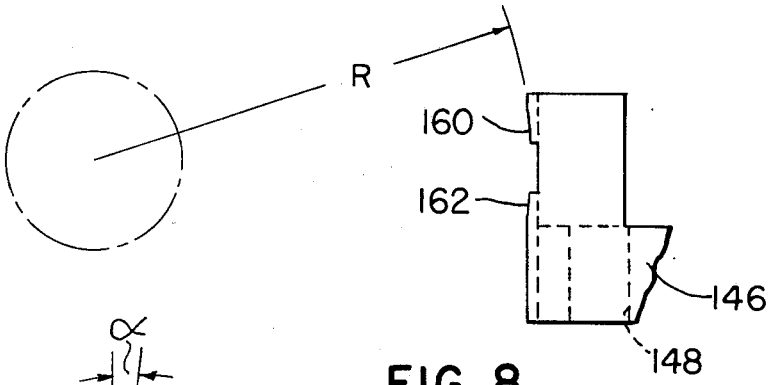
FIG. 8 is an enlarged view of FIG. 6 showing additional details of the sensing shoe.

This radius of curvature R is especially useful when printing upon multi-ply media. It is generally, extremely difficult to print upon multi-ply media having more than five or six copies or plies when using a wire matrix impact printer. For example, air usually exists between the plies of a multi-ply media, and if the energy level of the hammer actuators of the impact printer is adjusted to a high level to overcome this poor condition with air between the plies, then the impact wires of the printer will pierce the ribbon or a single ply medium when it is printed upon, unless the energy level of the hammer actuators is constantly adjusted to reflect the energy level required for the media being printed upon. The sensing shoe 146 of the present invention exerts a slight pressure on the media being printed upon to squeeze the air out from between the plies permitting improved image transfer and reduced broadening of the "character dots" on the last few copies of a multi-ply media being printed upon, and also permits a more economical use of the hammer actuator energy. The sensing shoe 146 has lands 160 and 162 (FIGS. 6, 7, and 8) and a horizontally positioned groove 158 (FIG. 7) located therebetween. The lands 160 and 162 lie on the radius R, have a width which is less than the distance between printed lines, and are located to lie between the printed lines. By this construction, the lands on the sensing shoe 146 compress the plies of a multi-ply media to effect an improved image transfer during printing and also avoid tracking over printed characters to avoid smudging them as the print head means 22 is traversed along the platen. A thin layer 161 (FIG. 7) of transparent plastic having a hole 163 therein is adhesively secured to the face of the shoe 146 at a recessed area 165 (FIG. 5) provided therefor. The layer 161 protects the ribbon from the edges of the media on the platen 26, and the hole 163 permits the wire plungers 92 to pass therethrough.

The operation of the forms compensator of this invention is as follows. Assume that the media on the platen 26 consists of a single journal sheet 34 and a pass book 36 which is positioned over a portion of the sheet 34 as shown in FIG. 1. The sensing shoe 146 and print head means 22 are urged against the journal sheet 34 by the leaf spring 114 of the biasing means 30 (FIG. 2). As print head means 22 is traversed across the platen 26 by the traversing means 24, the sensing shoe 146 glides across the journal sheet 34 to maintain the end 98 of the print head a fixed distance away from the journal sheet 34. As the leading edge 162 of the sensing shoe 146 contacts the thicker pass book 36, the sensing shoe will pivot on pin 150 in a clockwise direction (as viewed in FIG. 1) and push the end 98 of the print head away slightly from the platen against the bias of the leaf spring 114 to maintain the end 98 at substantially a fixed distance from the platen and journal sheet 34. This fixed distance is naturally dependent upon the type of printer used; however, in the embodiment shown, the distance was 0.010 to 0.025 inch. As the print head means 22 is traversed further to the right side of the platen 26, the trailing edge 154 of the shoe 146 will contact the leading edge of the pass book, and the shoe 146 will ride entirely on the pass book. Upon completion of a line of printing, the platen 26 will be indexed by conventional means and the print head means 22 will be returned to the left margin of the platen or home position by the traversing means 24. If, for example, the pass book 36 is to be removed after making an entry thereon, the lever 136 may be manually rotated to rotate square bar 120 in a clockwise direction (or the solenoid 142 (FIG. 1) may be energized) causing lever 116 to rotate in a clockwise direction (as viewed from FIG. 2) and thereby push the print head means 22 away from the platen 26. With the print head means 22 moved away from the platen, the media positioned thereon can be easily removed therefrom and new media can be easily positioned thereon. The controls for operating the stepping motor 60, solenoid 142, platen 26 and print head means 22 may be conventional, and accordingly, need not be described in any further detail. While this invention is described in conjunction with a wire matrix printer, this invention may be used with other printers in which it is desirable to keep the print head thereof fixed distances away from media of various thicknesses located on the associated platens.

Figure 4:
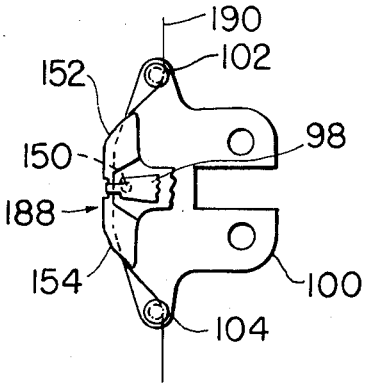
FIG. 4 is an enlarged plan view of a sensing shoe used for contacting the media located on the platen.
Figure 5:
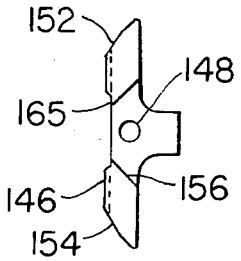
FIG. 5 is an enlarged plan view of another sensing shoe used with this invention.
Figure 7:
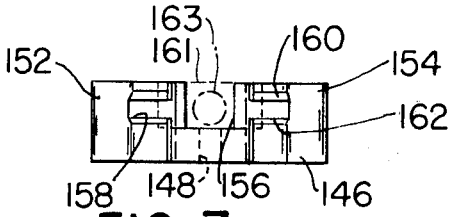
FIG. 7 is a front view, in elevation of the sensing shoe shown in FIGS. 5 and 6, as seen from the platen.
Figure 6:
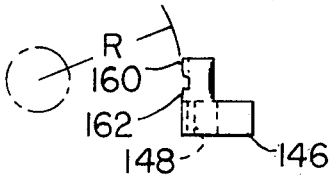
FIG. 6 is a side view, in elevation, of the sensing shoe shown in FIG. 5.

Another embodiment of the sensing shoe used in the sensing means 32 is shown in FIG. 4. This sensing shoe 188 is similar to sensing shoe 146, except that it is not as long as the shoe 146 when measured along a line of printing on the platen. Sensing shoe 188 has the same edges 152 and 154 as shoe 146 and is pivotally mounted on the same pin 150 secured to plate 100. Shoe 188 is especially useful for printing on a type of carbonless paper which does not require a ribbon, and so the ribbon deflector guides 107 and 109 can be eliminated permitting greater visibility of the characters being printed by the wire matrix printer whose end 98 is shown in FIG. 4. If it is necessary to use a ribbon with shoe 188, a smudge-proof ribbon 190 is routed around post 102, around the face of shoe 188, and around the post 104 (FIG. 4). Because the shoe 188, in such a situation, rides directly on the ribbon which is positioned between the face of the shoe and the media on the platen, the unit presssure of the shoe against the ribbon (resulting from the bias of spring 114 in FIG. 2) would have to be adjusted to avoid smudging the first copy of the multi-copy media.

Figure 9:
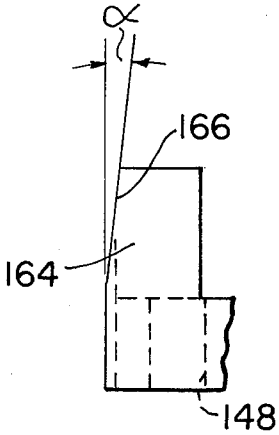
FIG. 9 is a side view, in elevation, of a third embodiment of a sensing shoe used with this invention.
Figure 10:
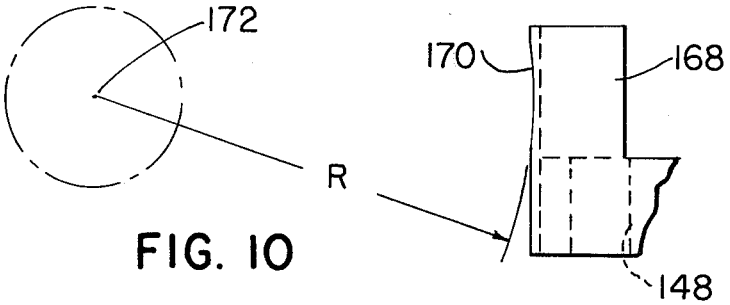
FIG. 10 is a side view, in elevation, of a fourth embodiment of a sensing shoe used with this invention.

FIGS. 9 and 10 show two additional different embodiments of the sensing shoe used with this invention. The shoe 164 is the same as shoe 146 except for the points of differences mentioned hereinafter. The shoe 164 has a hole 148 therein for mounting it on pin 150 as was done with shoe 146. The shoe 164 has a flat surface 166 which makes an angle of $\alpha°$ with a vertical line. The angle $\alpha$ is chosen to enable the surface 166 to contact the media on the platen 26 along a line which corresponds to the land 162 of FIG. 8. One advantage of the shoe 164 is that it does not have to be accurately located relative to the centerline of the associated platen with which the shoe is used. The line contact of shoe 164 produces an increased unit pressure on the media on the platen 26 over that produced by the shoes shown in FIGS. 8 and 10, which increased pressure can cause smudging; however, tests with multi-ply carbon copies have not shown this to be a problem due to the low pressure (¼ to ½ lb.) required of leaf spring 114 (FIG. 2) in urging the print head means 22 towards the platen 26.

The sensing shoe 168, shown in FIG. 10, is a shoe which is especially useful with ink ribbons which are smudge resistant. The shoe 168 is identical to shoe 146 except that it does not have the lands 160 and 162 shown in FIG. 8. Instead, shoe 168 has a continuous concave surface 170 having a radius R. The shoe is carefully located so that the center of the concave surface 170 lies in a plane passing through the center 172 of the associated platen. This shoe 168 is better able to press out the air between the plies of a multi-ply media and to make the media conform to the associated platen along the line of printing to thereby enable the associated print head to produce better quality copies.

Figure 11:
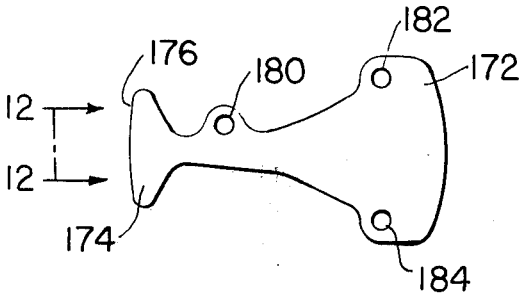
FIG. 11 is a plan view of a modified form of a sensing shoe which may be combined with the housing of the print head means.

When carbonless paper is used in a multi-ply media being printed upon, the sensing shoe used with this invention may be modified as shown in FIGS. 11 and 12. FIG. 11 shows a wire guide or housing 172 which houses the wire plungers 92 (FIG. 2) of a wire matrix print head. The operative end of the wire guide or housing 172 has a sensing shoe 174 formed thereon. The shoe 174 has a curved convex wall 176 shown in FIG. 11 to provide chamfered edges for gliding over the media of varying thicknesses on an associated platen. The curved convex wall 176 is essentially vertical and has openings 178 (FIG. 12) therein from which the wire plungers (like 92 is FIG. 2) emerge to impact against the media. The housing 172 has mounting holes 180, 182 and 184 for mounting it on the print head means 22 shown in FIG. 1, and the housing is secured thereto by inserting fasteners 186, 188 and 190 respectively, in these holes. The shoe 174 presses the media closer to the face 176 of the housing 172 than does any of the other sensing shoes described herein, and accordingly, the use of shoe 174 enables the greatest number of plies of a multi-ply media to be printed upon. The wire plungers (like 92 in FIG. 2) are withdrawn within the holes 178 (FIG. 12) when in the inactive state to enable the plungers to be accelerated (when energized) to obtain the required hammer impact energy prior to emerging from the holes 178.

When the print head means 22 is traversed at a rapid stepping rate along the platen 26 by the traversing means 24, the action of the sensing means 32 in riding up a thicker medium on the platen causes a force pulse urging or bouncing the print head means 22 away from the platen. The faster the stepping or printing rate, the greater is the force pulse which is created in moving the print head means 24, and as a result, damping may be needed to minimize the bouncing or moving away of the print head means from the platen.

A damping means which may be used with this invention, should bouncing of the print head means 22 become a problem, is shown in FIGS. 2 and 3. An elastomeric block 180, made of a material like polyurethane rubber, is bonded to the surface 182 of the base 62 of the print head unit 86 and is also bonded to a plate 184 which is free to slide on surface 186 of the carriage member 46. The block is compressed sufficiently through conventional trial and error techniques so that the combined drag force created by the partially compressed block 180 and plate 184 is a fraction (like ⅓ to ½) of the force of leaf spring 114 which urges the print head unit 86 towards the platen 26. Small motions of the print head means 22 away from the platen 26 are damped by the block 180 alone, and larger motions of the print head means are additionally damped by the sliding of plate 184 on surface 186. If the retract motion of the print head means 22 to the position shown by the dashed outline 144 is not desired, the plate 184 can be eliminated, and the block 180 may be bonded directly to the surface 186.

What is claimed is:

1. A forms compensator for sensing the thicknesses of various media mounted on a platen of a serial-type line printer comprising:

a carriage means having a print head means thereon;

traversing means for traversing said carriage means along said platen to enable said print head means to print along a straight line of printing on said platen;

mounting means for mounting said print head means which includes a print head and a support member on said carriage means for simultaneous movement therewith along said line of printing and for independent reciprocal movement of said print head along a second line which is transverse to said line of printing;

biasing means secured to said print head for resiliently urging said print head along said second line towards said platen;

sensing means secured to said print head to contact the media on said platen and to move said print head away from said media as a thicker medium is encountered along said line of printing and to enable said biasing means to move said print head towards said platen as a thinner medium is encountered, thereby enabling said print head to be spaced a predetermined distance from said media along said line of printing regardless of the thickness of a particular medium on said platen;

said traversing means including an actuating bar mounted parallel to said line of printing and an actuating lever slidably mounted on said bar and mounted on said carriage means to be moved along said bar with said carriage means;

said support member having a well therein having first and second opposed faces;

said actuating lever having an end fitting into said well to engage said second face therein and move said print head along second line away from said platen to permit the insertion of media thereon when said actuating bar is rotated; and said biasing means including a biasing lever having one end fixed to said actuating lever and the free end thereof engaging said first face to resiliently move said print head along said second line towards said platen.

2. The compensator as claimed in claim 1 which said print head means is of the wire-matrix variety and includes a housing having an end out of which the associated wire plungers emerge during a printing operation, said sensing means including a sensing shoe which is formed on said end of said housing.

3. The compensator as claimed in claim 2 in which said end has a planar face which lies substantially tangent to the periphery of the associated platen and forms a part of said sensing shoe.

4. A forms compensator for sensing the thicknesses of various media mounted on a platen of a serial-type line printer comprising:

a carriage means having a print head thereon;

traversing means for traversing said carriage means along said platen to enable said print head means to print along a line of printing on said platen;

mounting means for mounting said print head means on said carriage means for simultaneous movement therewith along said line of printing and for independent reciprocal movement of said print head means along a second line which is transverse to said line of printing;

biasing means for resiliently urging said print head means along said second line towards said platen; and sensing means secured to said print head means to contact the media on said platen and to move said print head means away from said media as a thicker medium is encountered along said line of printing and to enable said biasing means to move said print head means towards said platen as a thinner medium is encountered, thereby enabling said print head means to be spaced a predetermined distance from said media along said line of printing regardless of the thickness of a particular medium on said platen;

said print head means including a support member having a vertically mounted pin thereon; and said sensing means including a shoe pivotally mounted on said pin with said shoe having opposed chamfered ends which are aligned along said line of printing and with said shoe being mounted on said pin between said chamfered ends, said shoe also having a central portion which is removed to permit viewing of said line of printing, and also having a face with a curvature therein; said curvature making the face compatable with the associated platen.

5. A forms compensator for sensing the thicknesses of various media mounted on a platen of a serial-type line printer comprising:

a carriage means having a print head means thereon;

traversing means for traversing said carriage means along said platen to enable said print head means to print along a line of printing on said platen;

mounting means for mounting said print head means on said carriage means for simultaneous movement therewith along said line of printing and for independent reciprocal movement of said print head means along a second line which is transverse to said line of printing;

biasing means for resiliently urging said print head means along said second line towards said platen; and sensing means secured to said print head means to contact the media on said platen and to move said print head means away from said media as a thicker medium is encountered along said line of printing and to enable said biasing means to move said print head means towards said platen as a thinner medium is encountered, thereby enabling said print head means to be spaced a predetermined distance from said media along said line of printing regardless of the thickness of a particular medium on said platen;

said print head means including a support member having a vertically mounted pin thereon; and said sensing means including a shoe pivotally mounted on said pin with said shoe having a face with an upper land and a lower land positioned in said face, with said lands being parallel to said line of printing and being spaced apart a distance which is greater than the height of the characters being printed along said print line.

6. A forms compensator for sensing the thicknesses of various media mounted on a platen of a serial-type line printer comprising:

a carriage means having a print head means thereon;

traversing means for traversing said carriage means along said platen to enable said print head means to print along a line of printing on said platen;

mounting means for mounting said print head means on said carriage means for simultaneous movement therewith along said line of printing and for independent reciprocal movement of said print head means along a second line which is transverse to said line of printing;

biasing means for resiliently urging said print head means along said second line towards said platen; and sensing means secured to said print head means to contact the media on said platen and to move said print head means away from said media as a thicker medium is encountered along said line of printing and to enable said biasing means to move said print head means towards said platen as a thinner medium is encountered, thereby enabling said print head means to be spaced a predetermined distance from said media along said line of printing regardless of the thickness of a particular medium on said platen;

said print head means including a support member having a vertically mounted pin thereon; and said sensing means including a shoe pivotally mounted on said pin with said sensing shoe having a face which is inclined away from said platen at a slight angle as measured from a vertical line, said face being positioned to contact the platen while being pivotally mounted on said pin.

7. A forms compensator for sensing the thicknesses of various media mounted on a platen of a serial-type line printer comprising:

a carriage means having a print head means thereon;

traversing means for traversing said carriage means along said platen to enable said print head means to print along a line of printing on said platen;

mounting means for mounting said print head means on said carriage means for simultaneous movement therewith along said line of printing and for independent reciprocal movement of said print head means along a second line which is transverse to said line of printing;

biasing means for resiliently urging said print means along said second line towards said platen; and sensing means secured to said print head means to contact the media on said platen and to move said print head means away from said media as a thicker medium is encountered along said line of printing and to enable said biasing means to move said print head means towards said platen as a thinner medium is encountered, thereby enabling said print head means to be spaced a predetermined distance from said media along said line of printing regardless of the thickness of a particular medium on said platen;

said print head means including a support member having a vertically mounted pin thereon; and said sensing means including a shoe pivotally mounted on said pin;

said traversing means including an actuating bar mounted parallel to said line of printing and an actuating lever slidably mounted on said bar and mounted on said carriage means to be moved along said bar with said carriage means;

said support member having a well therein having first and second opposed faces;

said actuating lever having an end fitting into said well to engage said second face therein and move said print head means along said second line away from said platen to permit the insertion of media thereon when said actuating bar is rotated; and said biasing means including a biasing lever having one end fixed to said actuating lever and the free end thereof engaging said first face to resiliently move said print head means along said second line towards said platen.

8. A forms compensator for sensing the thickness of various media mounted on a platen of a serial-type line printer comprising:

a carriage means having a print head means thereon; transversing means for transversing said carriage means along said platen to enable said print head means to print along a line of printing on said platen; mounting means for mounting said print head means on said carriage means for simultaneous movement therewith along said line of printing and for independent reciprocal movement of said print head means along a second line which is transverse to said line of printing; biasing means for resiliently urging said print head means along said second line towards said platen; and sensing means secured to said print head means to contact the media on said platen and to move said print head means away from said media as a thicker medium is encountered along said line of printing and to enable said biasing means to move said print head means towards said platen as a thinner medium is encountered, thereby enabling said print head means to be spaced a predetermined distance from said media along said line of printing regardless of the thickness of a particular medium on said platen;

said print head means including a support member having a vertically mounted pin thereon; and said sensing means including a shoe pivotally mounted on said pin with said shoe having opposed chamfered ends which are aligned along said line of printing and with said shoe being mounted on said pin between said chamfered ends, said shoe also having a central portion which is removed to permit viewing of said line of printing.

* * * * *

UNITED STATES PATENT OFFICE

CERTIFICATE OF CORRECTION

PATENT NO. : 3,990,560

DATED : November 9, 1976

INVENTOR(S) : Thomas J. Pavliscak and William S. Touchman

It is certified that error appears in the above-identified patent and that said Letters Patent are hereby corrected as shown below:

Column 10, line 18, after "1" should be --in--.

Column 10, line 32, after "head" should be --means--.

Signed and Sealed this

First Day of March 1977

[SEAL]

*Attest:*

RUTH C. MASON
*Attesting Officer*

C. MARSHALL DANN
*Commissioner of Patents and Trademarks*